US008240816B2

(12) United States Patent
O'Leary et al.

(10) Patent No.: US 8,240,816 B2
(45) Date of Patent: Aug. 14, 2012

(54) INK FILL PORT FOR INKJET INK TANK

(75) Inventors: Kevin J. O'Leary, Rochester, NY (US); Steven L. Moore, Dansville, NY (US)

(73) Assignee: Eastman Kodak Company, Rochester, NY (US)

( * ) Notice: Subject to any disclaimer, the term of this patent is extended or adjusted under 35 U.S.C. 154(b) by 347 days.

(21) Appl. No.: 12/642,883

(22) Filed: Dec. 21, 2009

(65) Prior Publication Data

US 2011/0148999 A1 Jun. 23, 2011

(51) Int. Cl.
*B41J 2/14* (2006.01)
*B41J 2/175* (2006.01)

(52) U.S. Cl. ..... 347/49; 347/86

(58) Field of Classification Search ..... 347/49, 347/85, 86, 87
See application file for complete search history.

(56) References Cited

U.S. PATENT DOCUMENTS

| | | | | |
|---|---|---|---|---|
| 5,682,189 | A * | 10/1997 | Takagi | 347/87 |
| 5,699,091 | A * | 12/1997 | Bullock et al. | 347/19 |
| 5,721,576 | A * | 2/1998 | Barinaga | 347/85 |
| 6,074,042 | A | 6/2000 | Gasvoda et al. | |
| 6,283,587 | B1 * | 9/2001 | Umemura | 347/86 |
| 7,086,725 | B2 | 8/2006 | Ogura et al. | |
| 7,614,732 | B2 * | 11/2009 | Miyazawa et al. | 347/86 |
| 7,699,453 | B2 * | 4/2010 | Ishizawa et al. | 347/86 |
| 7,708,394 | B2 * | 5/2010 | Kawamura et al. | 347/86 |
| 2002/0015607 | A1 | 2/2002 | Matich | |
| 2003/0052951 | A1 | 3/2003 | Ujita et al. | |
| 2003/0122910 | A1 | 7/2003 | Koshikawa et al. | |
| 2005/0140758 | A1 | 6/2005 | Merz et al. | |
| 2008/0204524 | A1 | 8/2008 | Petranek et al. | |
| 2009/0309940 | A1 | 12/2009 | Price | |

FOREIGN PATENT DOCUMENTS

| | | |
|---|---|---|
| EP | 0 903 236 A2 | 3/1999 |
| EP | 1 331 096 A2 | 7/2003 |

* cited by examiner

*Primary Examiner* — Anh T. N. Vo
(74) *Attorney, Agent, or Firm* — Peyton C. Watkins

(57) ABSTRACT

A detachably mountable ink tank for an inkjet printhead, the ink tank includes a housing for enclosing a reservoir for liquid ink; a rim extending outwardly from the housing; an ink supply port enclosed within the rim; and an ink fill port enclosed within the rim, wherein the ink fill port is configured to receive an ink fill tube to provide liquid ink to the reservoir.

19 Claims, 17 Drawing Sheets

INK FILL PORT FOR INKJET INK TANK

CROSS-REFERENCE TO RELATED APPLICATION

Reference is made to commonly assigned, co-pending U.S. patent application Ser. No. 23/753,885, filed Dec. 21, 2009, entitled "Method for Filling an Inkjet Ink Tank", by Douglas Kucmerowski, et al.

FIELD OF THE INVENTION

The present invention relates generally to an ink tank for an inkjet printhead, and more particularly to an ink fill port of a detachably mountable ink tank.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge so that the printhead needs to be replaced when the ink is depleted, or the ink tank can be detachably mounted to the printhead so that only the ink tank itself needs to be replaced when the ink tank is depleted.

One type of detachable ink tank includes a porous member (also called a wick or scavenger member) at the ink outlet port. The printhead inlet port can include a standpipe, for example, with a filter member at its inlet end. When the ink tank is mounted onto the printhead, the ink tank wick is held in contact with the filter member on the standpipe of the printhead inlet port. The ink outlet port of the ink tank includes a rim having a face that seals against a gasket surrounding the inlet port of the printhead when the ink tank is installed. The gasket seal provides a substantially airtight ink pathway from the ink tank to the printhead. Once the printhead is primed so that liquid ink fills the various ink passageways between the wick and the nozzles on the printhead, capillary action provides the force necessary to supply the ink to the nozzles as needed for printing. Such an ink tank facilitates easy and clean installation onto the printhead.

In prior art ink tanks that include a wick, capillary media such as felt or foam is used to retain ink inside the ink tank and provide a slight negative ink pressure so that ink does not drip out of the nozzles of the printhead. This ink-retaining capillary media thus serves as a pressure regulator and provides ink to the wick at the ink outlet port.

It has been found that pigment particles in a pigmented ink can settle out in ink tank designs where ink is stored in a capillary media pressure regulator, partly due to the restriction of motion of pigment particles within the small passages of the capillary media, as described in more detail in U.S. patent application Ser. No. 12/139,533. Such settling of pigments particles, especially for larger pigment particles (e.g. larger than 30 nanometers), can result in defective images during the printing process. As a result, an ink tank using capillary media to store ink can lead to a limitation in pigment particle size that can be used. Such a limitation can be disadvantageous, because such larger particles can be beneficial for providing higher optical density in printed regions.

A different type of pressure regulator for an ink tank is a bag (or flexible wall) with a spring that provides pressure regulation for a supply of liquid ink within a reservoir of the ink tank. Such ink tanks can have less of a tendency for settling out of pigment particles than for the case of ink stored in capillary media. In addition, as disclosed in U.S. Pat. No. 7,086,725, an ink tank having a flexible wall or a bag and a spring for pressure regulation can provide ink from the reservoir more efficiently (i.e. less ink trapped in the depleted reservoir) than an ink tank using capillary media ink storage to perform pressure regulation. This allows a more compact design of ink tank, printhead and printer for a given amount of usable ink in the ink tank.

For even more compact ink tank design, it is desirable to substantially eliminate air spaces in the ink tank during filling the reservoir with liquid ink. What is needed is an ink tank having an ink fill port that allows a more compact design.

SUMMARY OF THE INVENTION

The present invention is directed to overcoming one or more of the problems set forth above. Briefly summarized, according to one aspect of the invention, the invention resides in a detachably mountable ink tank for an inkjet printhead, the ink tank comprising a housing for enclosing a reservoir for liquid ink; a rim extending outwardly from the housing; an ink supply port enclosed within the rim; and an ink fill port enclosed within the rim, wherein the ink fill port is configured to receive an ink fill tube to provide liquid ink to the reservoir.

DETAILED DESCRIPTION OF THE INVENTION

Figure 1:
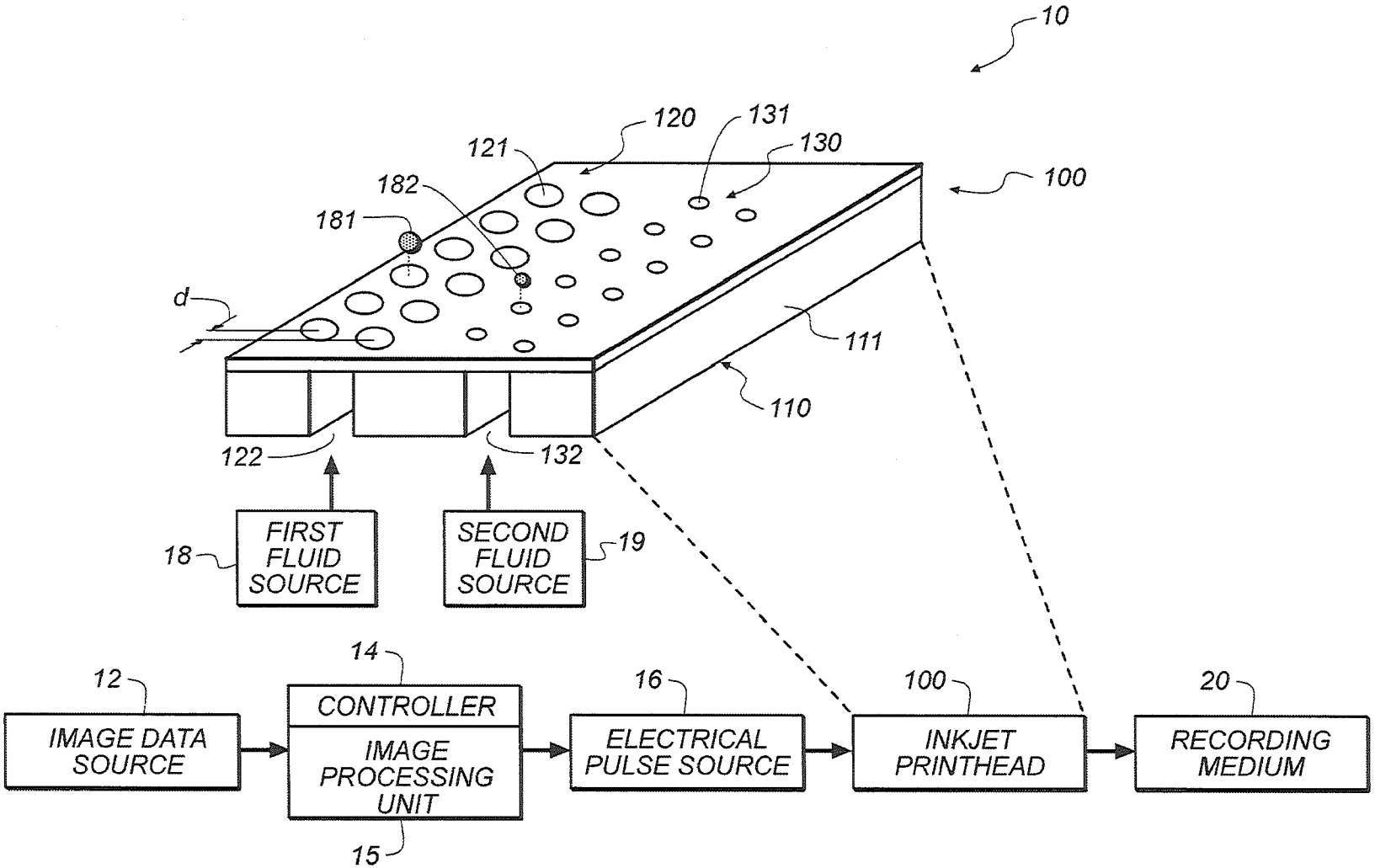
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
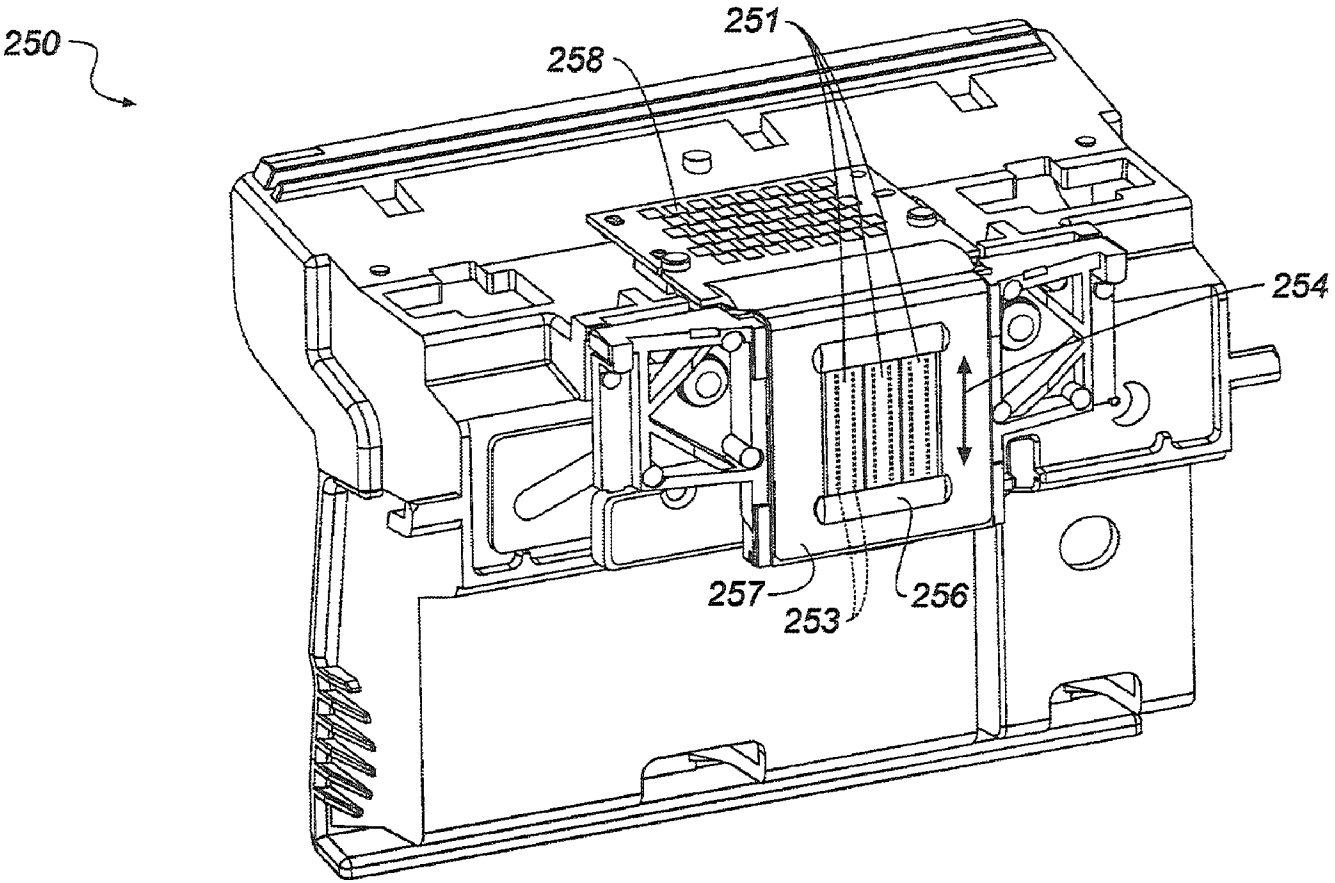
FIG. 2 is a perspective view of a portion of a printhead.

FIG. 2 shows a perspective view of a portion of a printhead 250, which is an example of an inkjet printhead 100. Printhead 250 includes three printhead die 251 (similar to printhead die 110 in FIG. 1), each printhead die 251 containing two nozzle arrays 253, so that printhead 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals can be transmitted to the printhead die 251.

Figure 3:
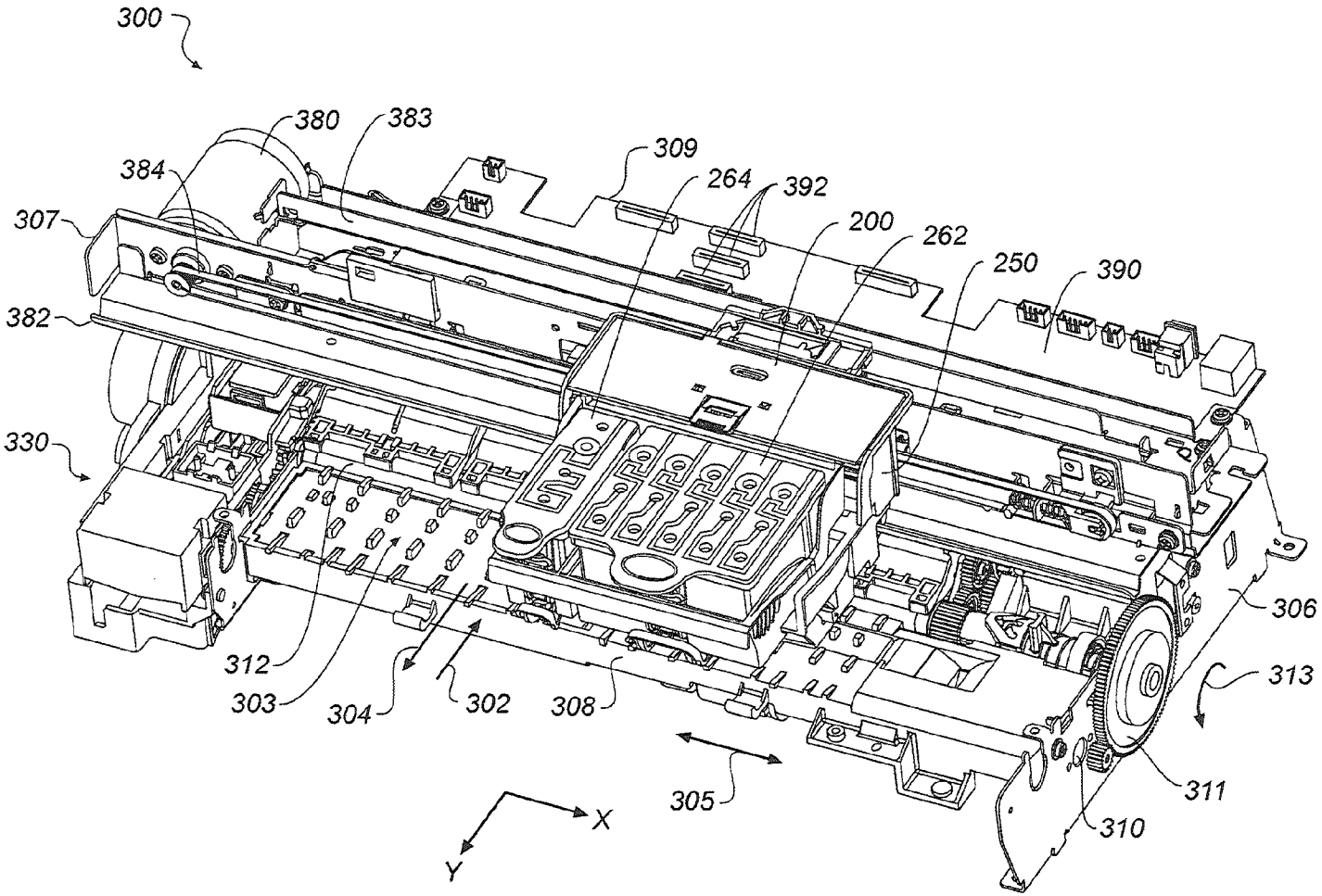
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are installed in the printhead 250. A printhead together with installed ink tanks is sometimes called a printhead assembly. The mounting orientation of printhead 250 is rotated relative to the view in FIG. 2, so that the printhead die 251 are located at the bottom side of printhead 250, the droplets of ink being ejected downward onto the recording medium in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. In other embodiments, rather than having a multi-chamber ink tank to hold several ink sources, all ink sources are held in individual single chamber ink tanks. Paper or other recording medium (sometimes generically referred to as paper or media herein) is loaded along paper load entry direction 302 toward the front of printer chassis 308.

Figure 4:
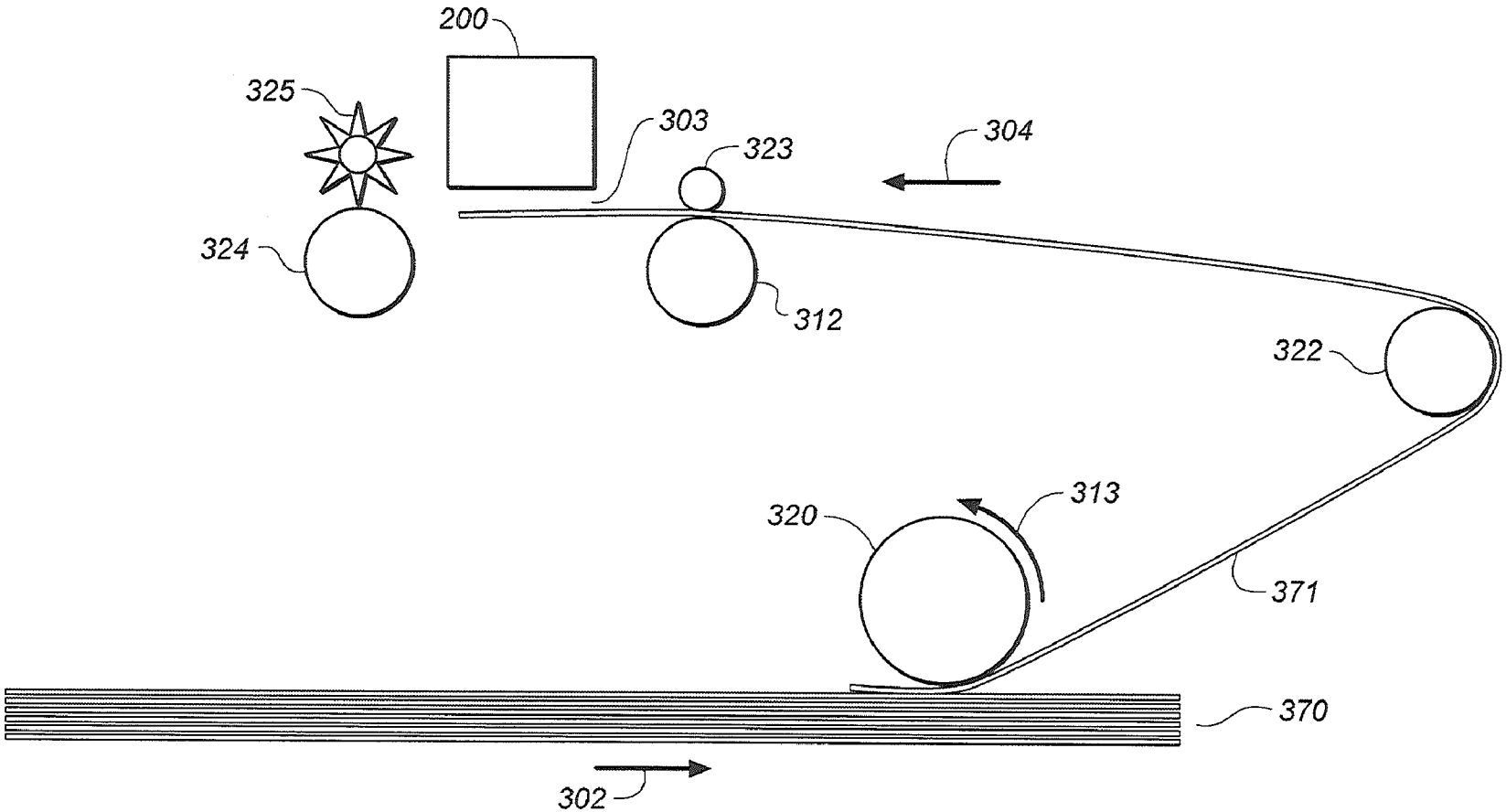
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
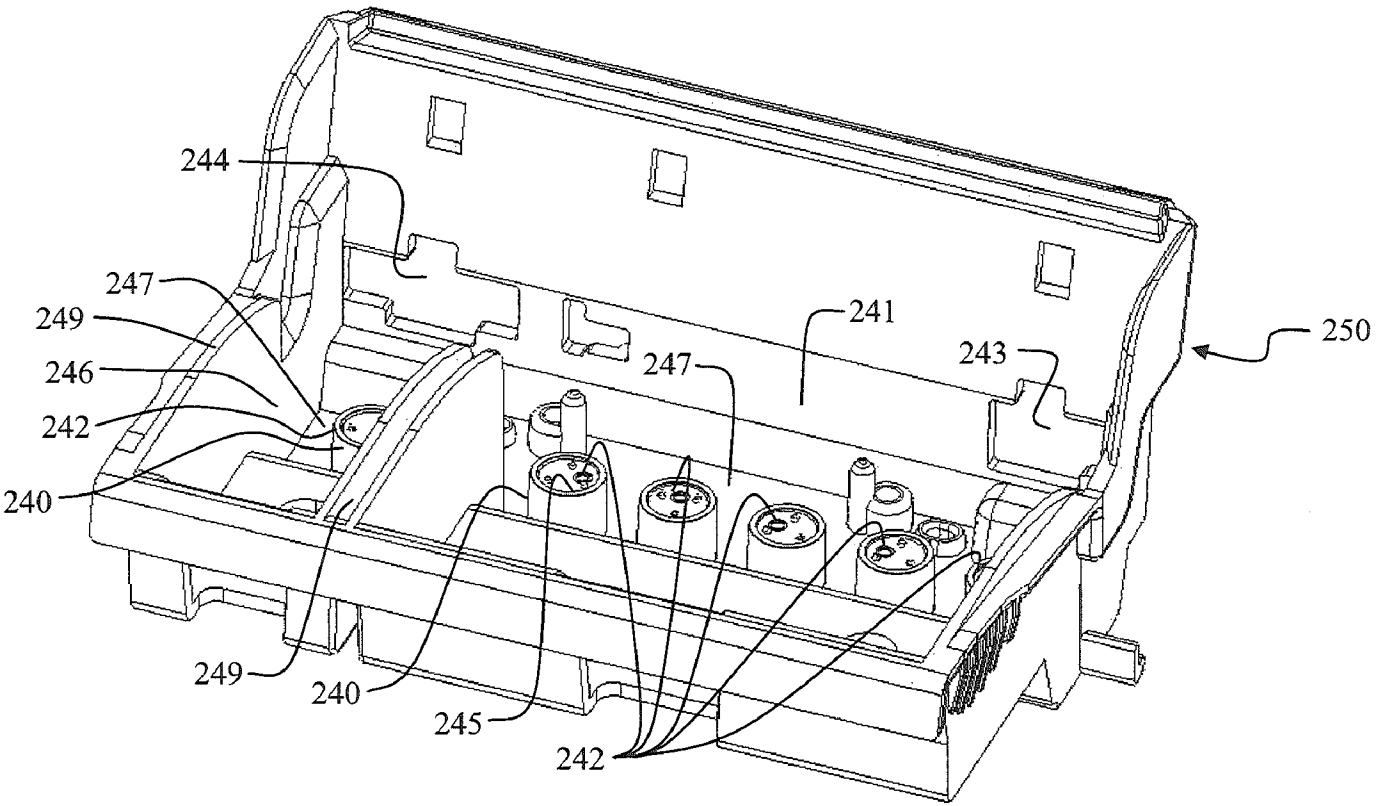
FIG. 5 is a perspective view of a portion of a printhead.

FIG. 5 shows a perspective view of printhead 250 (rotated with respect to the view of FIG. 2) without either replaceable ink tank 262 or 264 mounted onto it. Multi-chamber ink tank 262 is detachably mountable in ink tank holding receptacle 241 and single chamber ink tank 264 is detachably mountable in ink tank holding receptacle 246 of printhead 250. Ink tank holding receptacle 241 is separated from ink tank holding receptacle 246 by a wall 249, which can also help guide the ink tanks during installation. In some embodiments, pedestal 280 (see FIG. 6) of single chamber ink tank 264 is inserted into hole 244 of printhead 250 during mounting of the single chamber ink tank 264. A similar pedestal (not shown) on multi-chamber ink tank 262 is inserted into hole 243 of printhead 250 during mounting of the single chamber ink reservoir 264. Five inlet ports 242 are shown in region 241 that connect with ink outlet ports (not shown) of multi-chamber ink tank 262 when it is installed onto printhead 250, and one inlet port 242 is shown in region 246 for the ink supply port 275 (see FIG. 6) on the single chamber ink tank 264. In the example of FIG. 5 each inlet port 242 has the form of a standpipe 240 that extends from the floor of printhead 250. Typically a filter (such as woven or mesh wire filter, not shown) covers the end 245 of the standpipe 240. The diameter of end 245 of standpipe 240 is smaller than that of the opening of ink supply port 275 (see FIG. 6) of ink tank 262 or 264, so that the end 245 of each standpipe 240 is pressed into contact with a corresponding wick 276 at the opening of ink supply port 275. In other words, wick 276 serves as a printhead interface member for the ink tank. On the floor of printhead 250 surrounding standpipes 240 of inlet ports 242 is an elastomeric gasket 247. When an ink tank is installed into the corresponding ink tank holding receptacle 241 or 246 of printhead 250, it is in fluid communication with the printhead because of the connection of the wicks 276 at ink supply ports 272 with the ends 245 of standpipes 240 of inlet ports 242.

Figure 6:
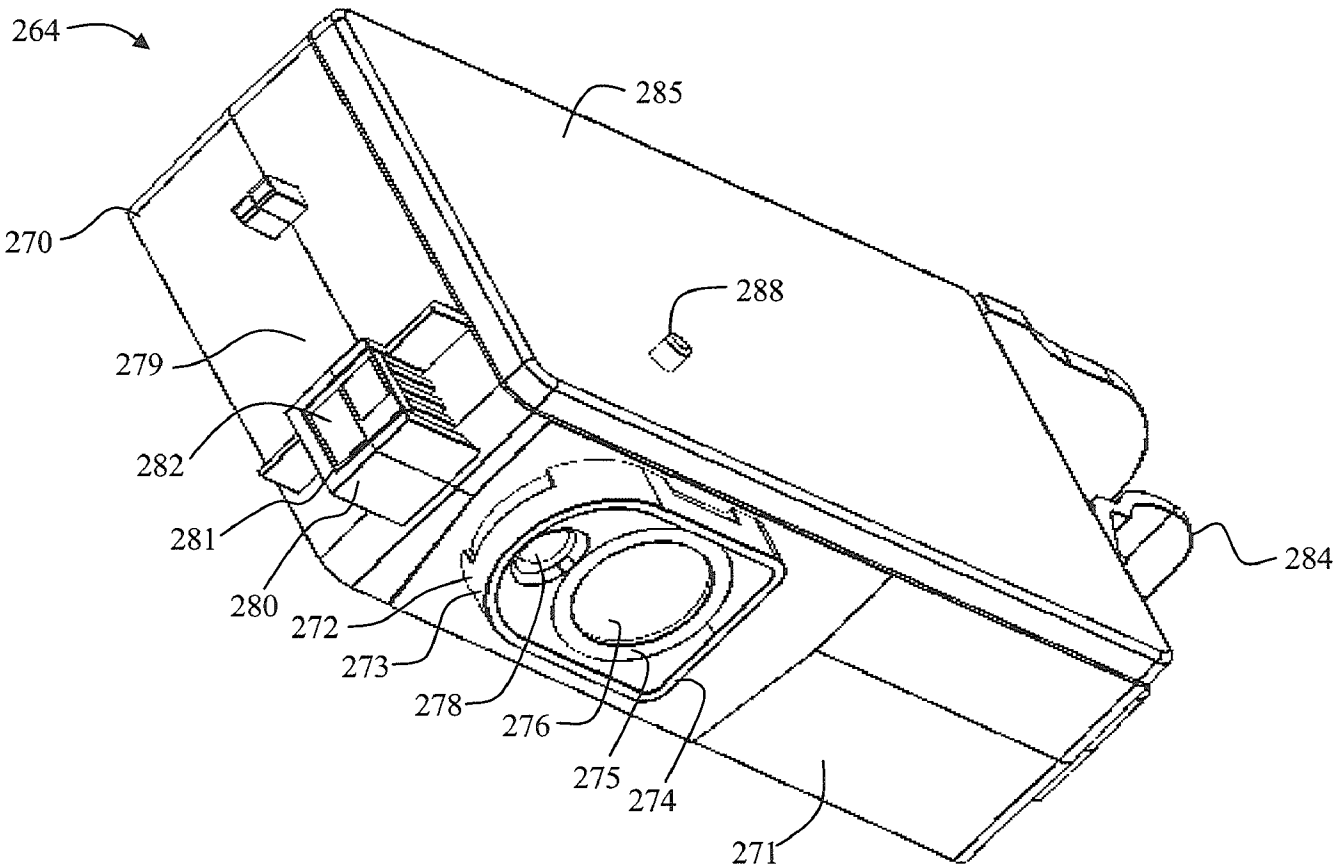
FIGS. 6-8 are perspective views of an ink tank according to an embodiment of the invention.
Figure 7:
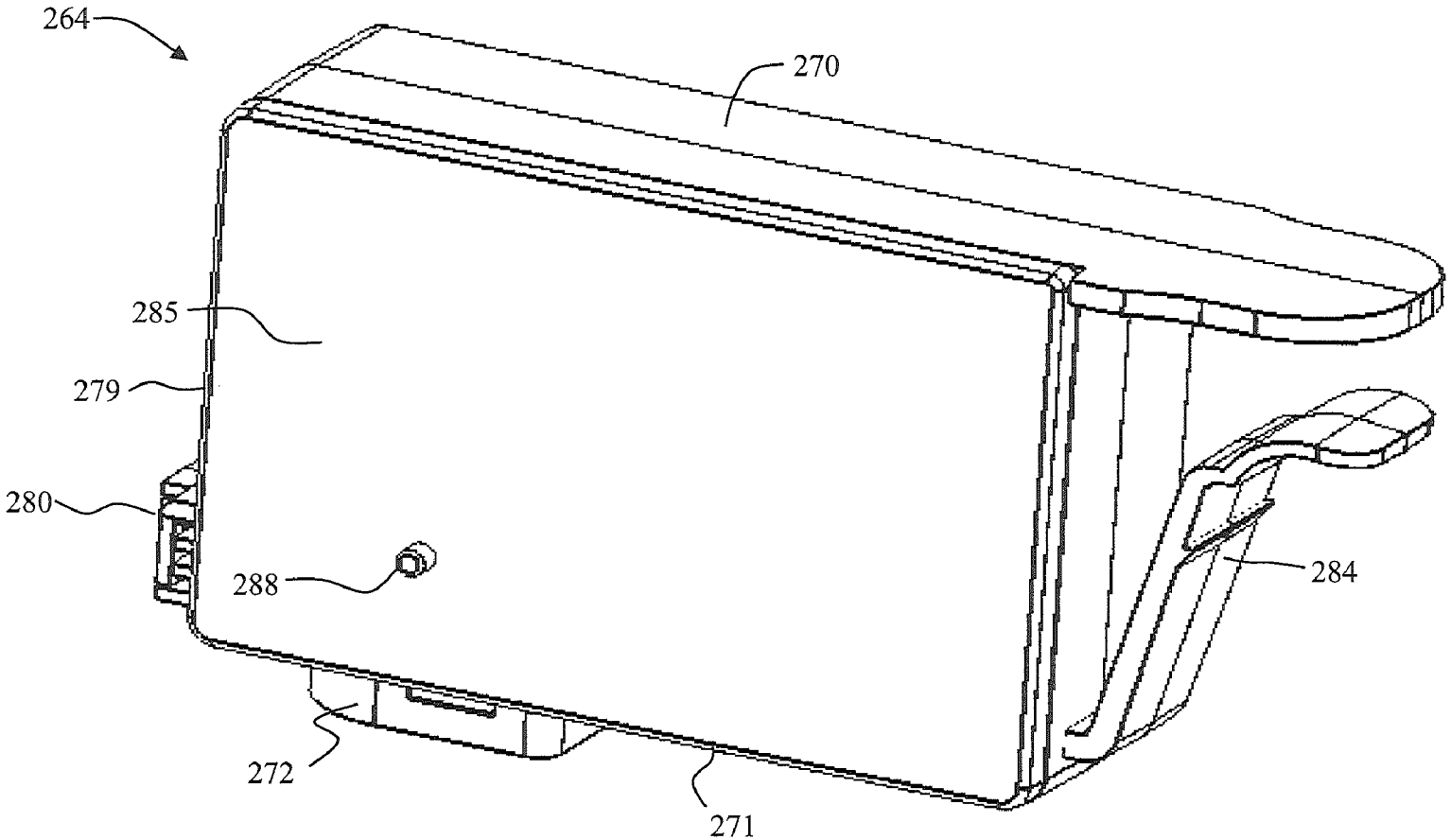
Figure 8:
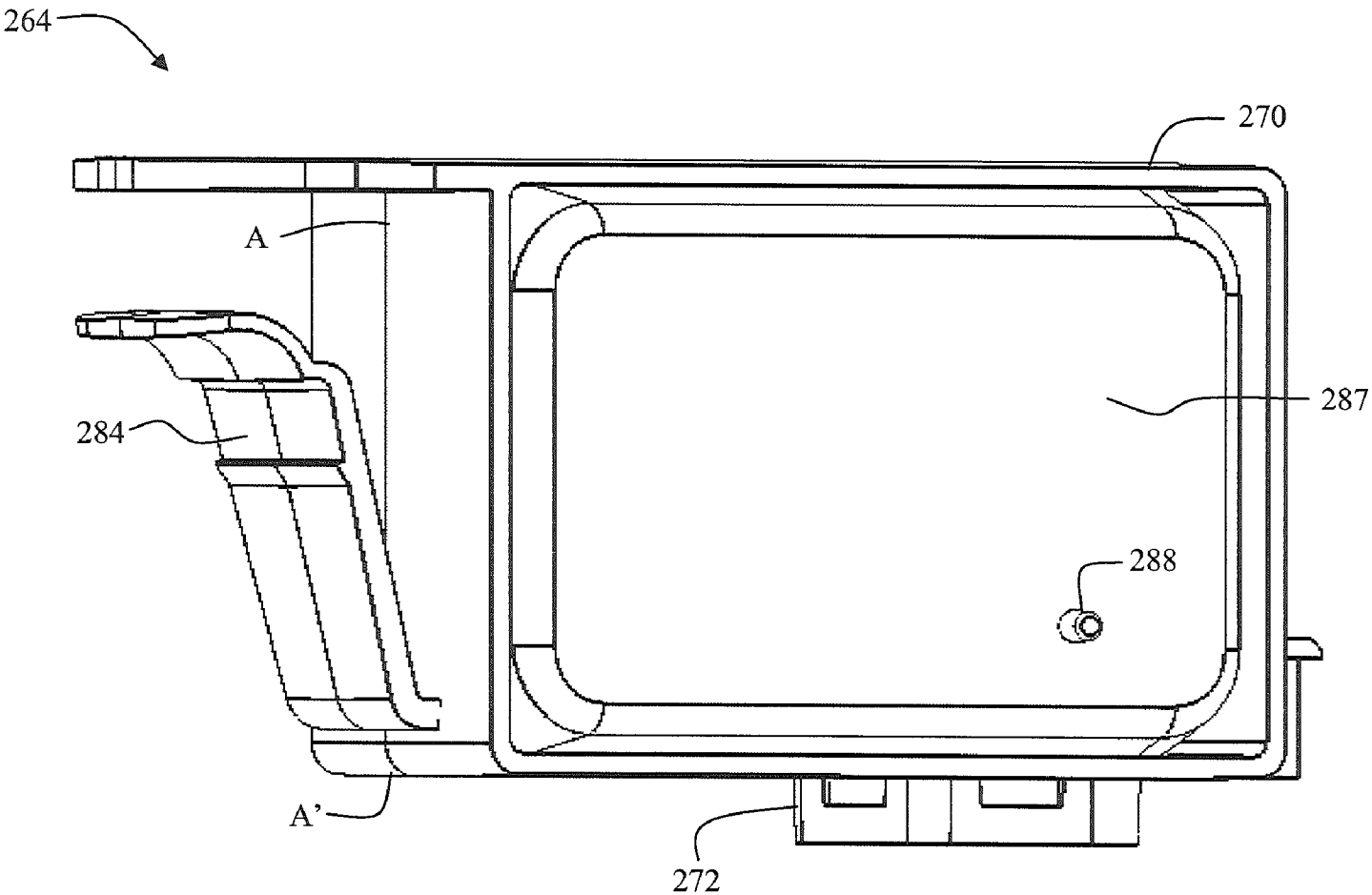

FIG. 6 shows a bottom perspective view and FIGS. 7 and 8 show side perspective views of opposite side faces of single chamber ink tank 264 according to an embodiment of the invention. Enclosed within housing 270 of the ink tank is a reservoir for liquid ink. Port member 272 extends from a bottom wall 271 of housing 270. Port member 272 has an external rim 273, which is oblong shaped. Rim 273 typically extends outwardly from the housing 270 by one centimeter or less. Enclosed within rim 273 are ink supply port 275 and ink fill port 278. Wick 276 is disposed at the opening of ink supply port 275 for transferring of ink from the reservoir of single chamber ink tank 264 to the corresponding inlet port of printhead 250. Wick 276 is a capillary medium that can be made of a fibrous material (such as a felted material) or a sintered material (such as a sintered plastic) in various embodiments. Rim 273 includes a face 274 that is configured to be sealingly fitted against gasket 247 of printhead 250 (see FIG. 5). Face 274 of rim 273 is pressed into contact with gasket 247 of printhead 250 (see FIG. 5) to form a seal when the ink tank is installed in printhead 250. The seal of face 274 against gasket 247 helps to prevent air leakage into printhead 250, as air bubbles can block the flow of ink in small ink passageways and thereby degrade print quality. A latching lever 284 extends outwardly from housing 270 in order to secure the single chamber ink tank 264 into ink tank holding receptacle 246 when the ink tank is installed in printhead 250.

Cover plate 285 is attached to one side of housing 270 (FIG. 7) while rigid wall 287 on the opposite side is integrally formed with housing 270 (FIG. 8). Extending outwardly from both cover plate 285 and rigid wall 287 are protrusions 288 that ride on walls 249 of ink tank holding receptacle 246 (see FIG. 5) during ink tank installation. In some embodiments, a pedestal 280 extends outwardly from a different wall 279 of housing 270 than the wall 271 from which rim 273 extends. Mounted on pedestal 280 is an electrical device 281 including electrical contacts 282. Electrical device 281 can be a memory device or a "smart chip" for storing information about the ink tank and its contents, as well as usage of ink, for example. Alternatively, electrical device 281 can be as simple as a passive circuit with electrical contacts 282 in order to signal to the printer controller 14 that the ink tank has been properly installed in a printhead 250 in carriage 200. Electrical contacts 282 of electrical device 281 make contact with an electrical connector (not shown) on carriage 200, as pedestal 280 extends though hole 243 or 244 in printhead 250 (see FIG. 5).

Especially for embodiments such as that shown in FIGS. 5 and 6, where the port member 272 extends outwardly from one wall 271 of housing 270, and where a pedestal 280 or an alignment feature extends outwardly from a different wall 279 of housing 270 and must be inserted into a hole in printhead 250 while ink supply port 275 is being connected to corresponding inlet port 242, it is preferred that the ink tank be installed at an angle initially, and then rotated into position. Such an ink tank installation is described in more detail in US Patent Application Publication 2008/0151010, which is incorporated herein by reference in its entirety. For such an ink tank installation, it is beneficial for the port member 272 and its rim 273 to be elongated in the direction of tank installation. This is a reason for the oblong shape of rim 273, as seen in the example of FIG. 6. Although rim 273 is oblong, ink supply port 275 enclosed within rim 273 can be substantially circular with a diameter larger than the diameter of inlet port 242 of printhead 250. Having a circular ink supply port 275 and an oblong rim 273 allows ink fill port 278 also to be enclosed within rim 273 of port member 272. A preferred location for ink fill port 278 is adjacent to ink supply port 275, and, more particularly, between ink supply port 275 and the wall 279 of housing 270 from which pedestal 280 extends.

Figure 9:
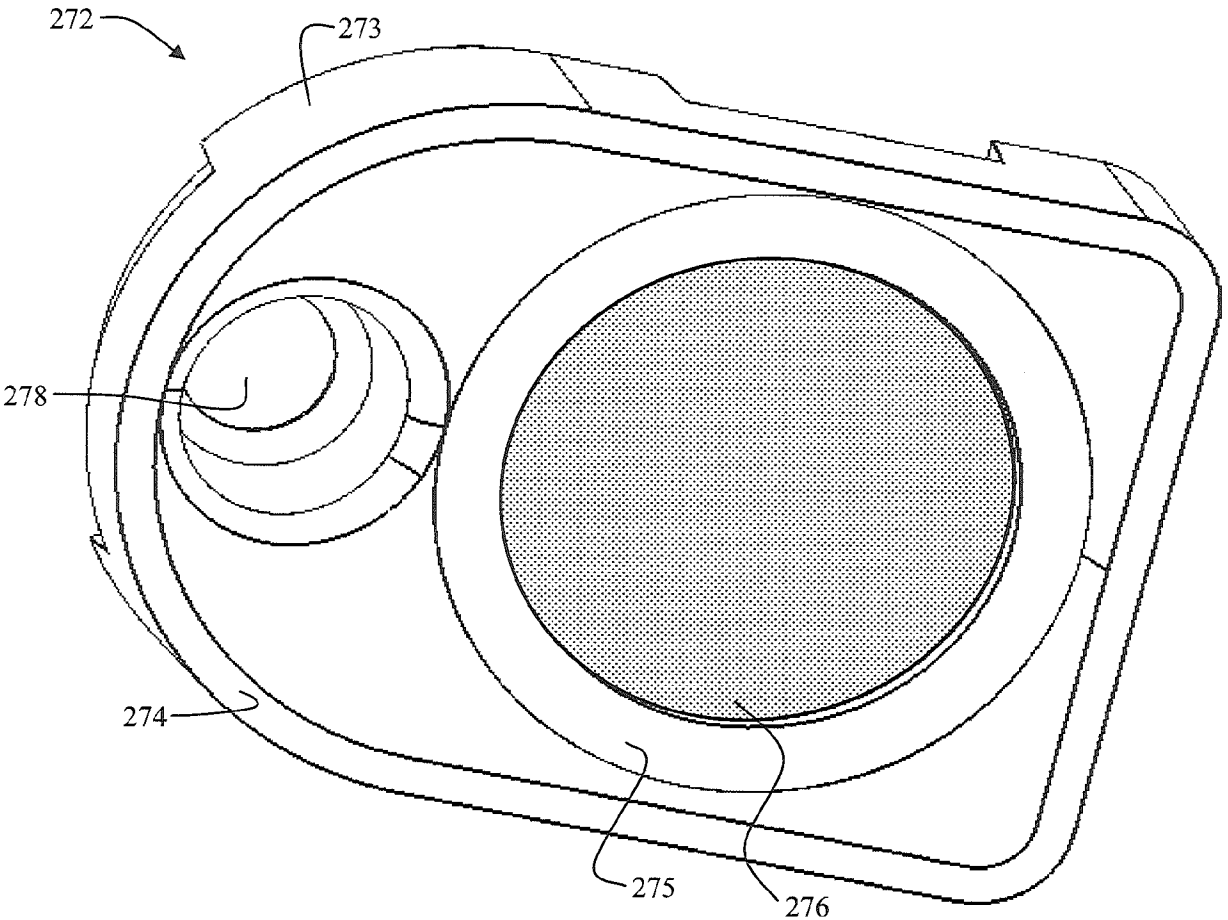
FIGS. 9-10 are enlarged perspective views of a port member according to an embodiment of the invention.
Figure 10:
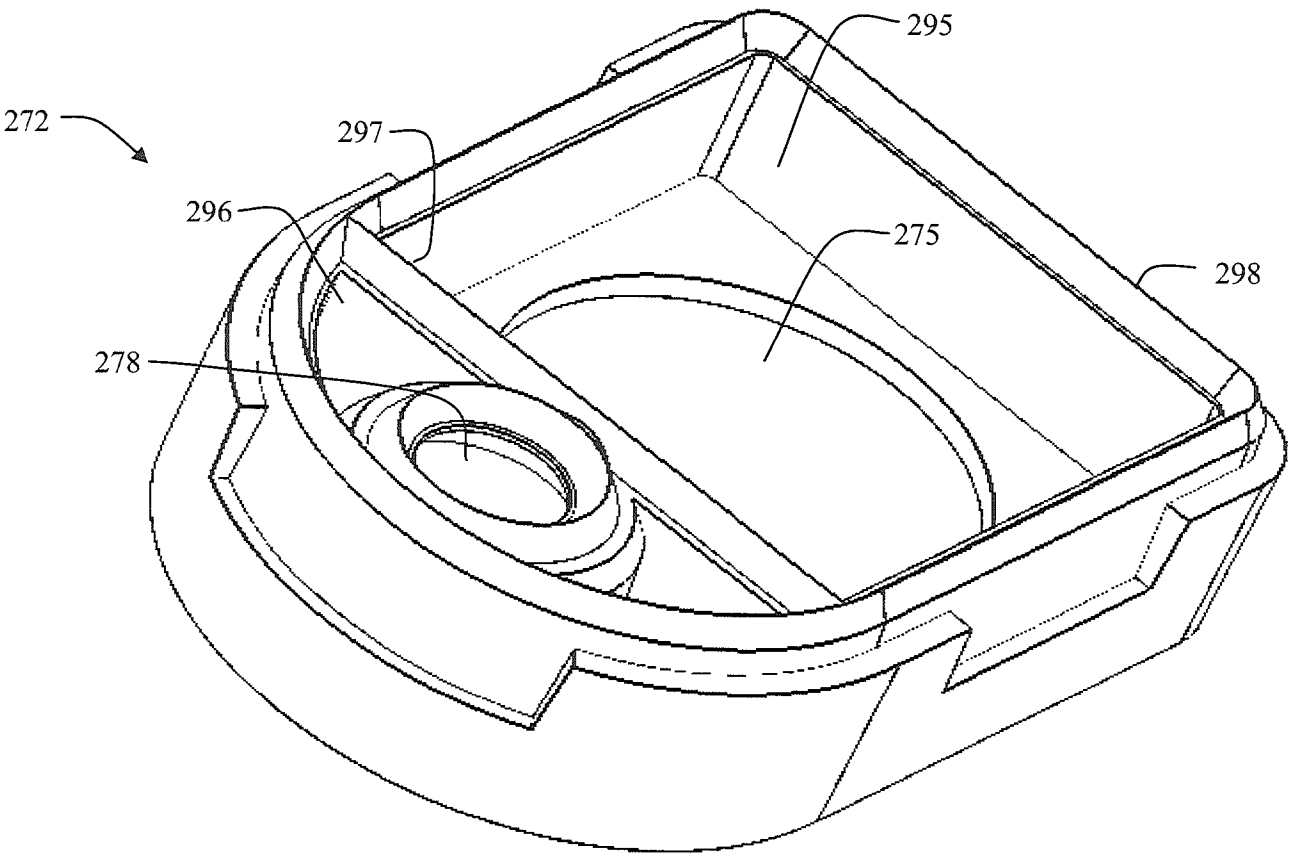

An enlarged bottom perspective view of port member 272 (as would be seen from outside the ink tank) is shown in FIG. 9, including the ink supply port 275, the wick 276, the ink fill port 278, the rim 273, and the rim face 274. Port member 272 can be made, for example, as a molded component by injection molding it separately from housing 270 (see FIGS. 6-8). Subsequently, port member 272 can be affixed to wall 271 of housing 270, for example by ultrasonic welding. FIG. 10 is a perspective view of port member 272 rotated relative to FIG. 9 so that the interior portion of the port member 272 can be seen. Port member 272 has a first compartment 295 including the ink supply port 275, a second compartment 296 including the ink fill port 278, a wall 297 that separates the first compartment 295 from the second compartment 296, and an attachment surface 278 for attachment of port member 272 to wall 271 of housing 270. Attachment surface 298 can include wall 297. An air-tight seal can be provided by the wall 297 between the first compartment 295 and the second compartment 296 during the attachment of port member 272 to housing 270. The wick is not shown in FIG. 10, so that the opening of the ink supply 275 can be seen. The wick can be a square piece of felted material that fits into first compartment 295 before fixedly attaching port member 272 to housing 270.

Figure 11:
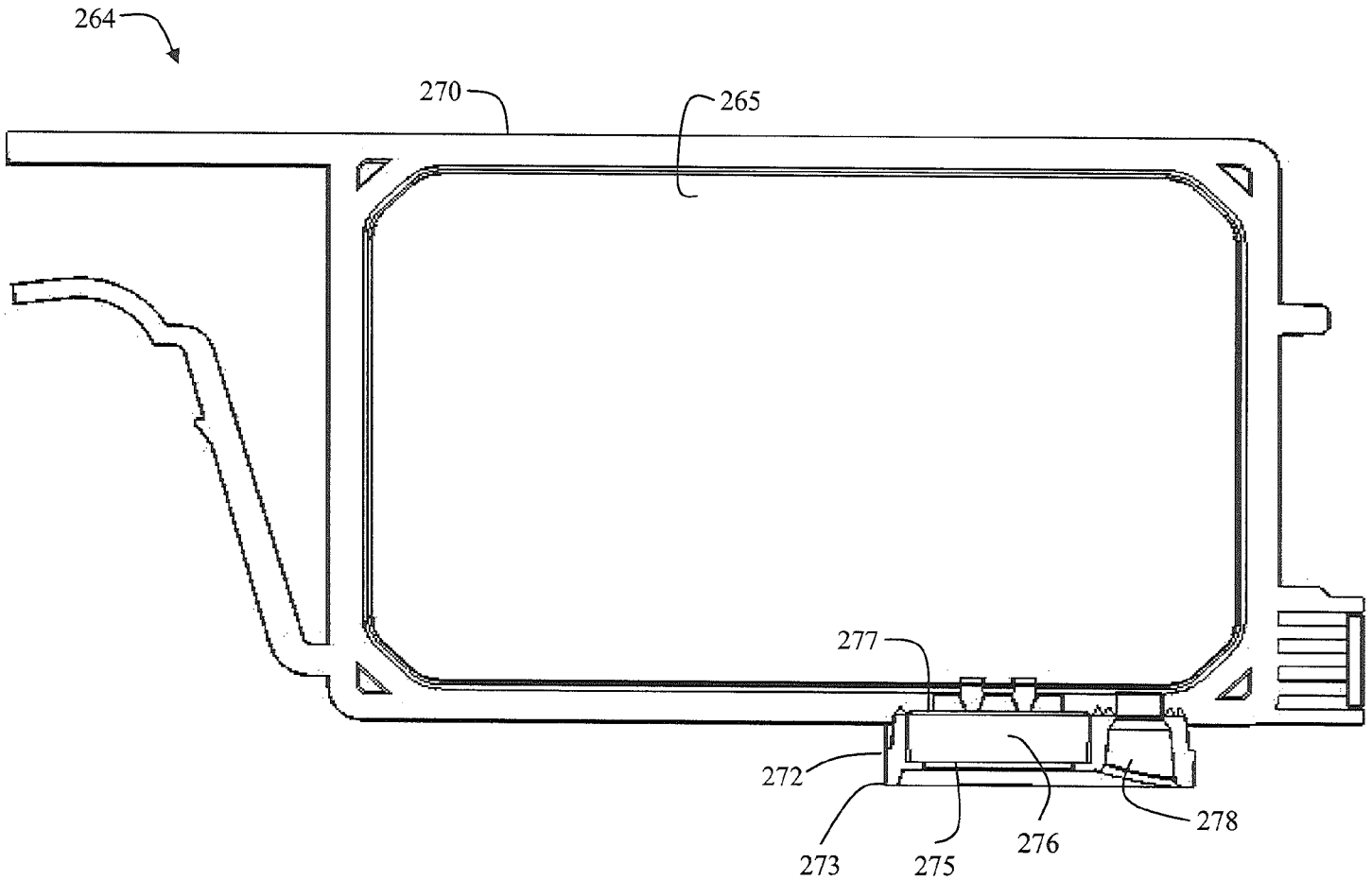
FIG. 11 is a cross sectional view of an ink tank according to an embodiment of the invention.

FIG. 11 is a cross-sectional view of single chamber ink tank 264 through A-A' of FIG. 8. Reservoir 265 for holding liquid ink is enclosed within housing 270. Wick 276 includes a first face at the opening of ink supply port 275, such that the first face is configured to contact ink inlet port 242 (see FIG. 5) of printhead 250 when the ink tank is installed. Opposite the first face of wick 276 is a second face. A mesh screen 277 is disposed adjacent this second face of wick 276 in some embodiments as described below.

Figure 12:
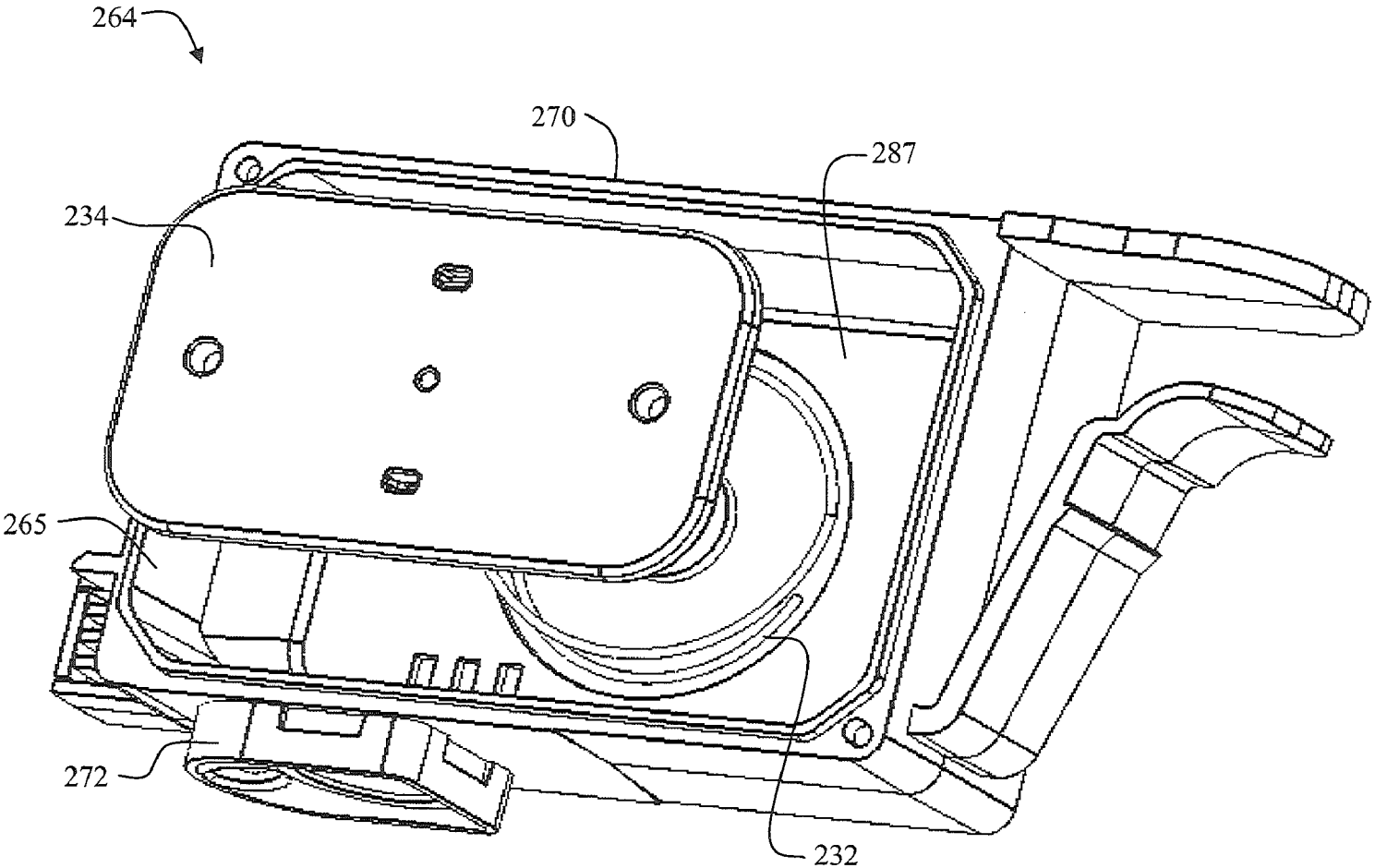
FIGS. 12-13 are perspective views of an ink tank having a reservoir with a flexible wall according to an embodiment of the invention.
Figure 13:
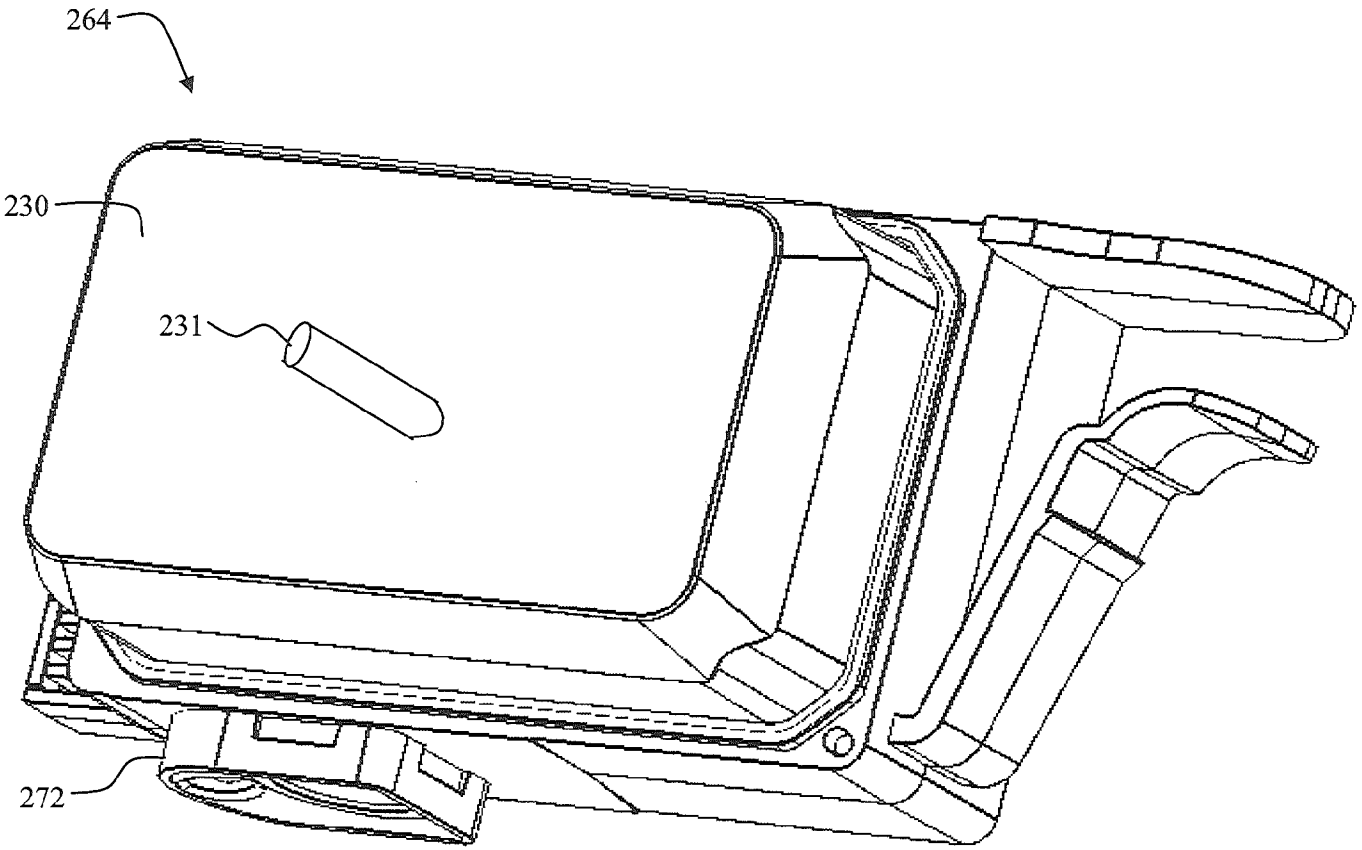

In some embodiments reservoir 265 includes a flexible wall and a spring to provide pressure regulation. FIG. 12 shows spring 232, but the flexible wall is hidden in FIG. 12 in order to show other features more clearly. FIG. 13 is similar to FIG. 12, but shows flexible wall 230. Comparing FIGS. 7, 12 and 13, the extent of expansion of flexible wall 230 in FIG. 13 is exaggerated to show it more clearly. In actuality, flexible wall 230 would not extend past the position of cover plate 285. Similarly, spring 232 and plate 234 (FIG. 12) that provide pressure to expand flexible wall 230 would also not extend past the position of cover plate 285. In some embodiments, a finger 231 is pressed against flexible wall 230 during the filling process to limit how far outwardly the flexible wall 230 can extend. Finger 231 can be set in different places depending on what volume of ink is desired to be filled into reservoir 265. Spring 232 presses against rigid wall 287 of housing 270. Liquid ink is contained in reservoir 265 between rigid wall 287 and flexible wall 230. As ink is being depleted from reservoir 265 by printing, spring 232 and flexible wall 230 maintain a suitable negative pressure on the ink so that ink does not drip out of the nozzles of printhead 250. In such an embodiment, a function of mesh screen 277 is to control the passage of air through ink supply port 275. When screen 277 is wetted by ink, air is unable to pass through, so that a suitable negative pressure can be maintained.

Figure 14:
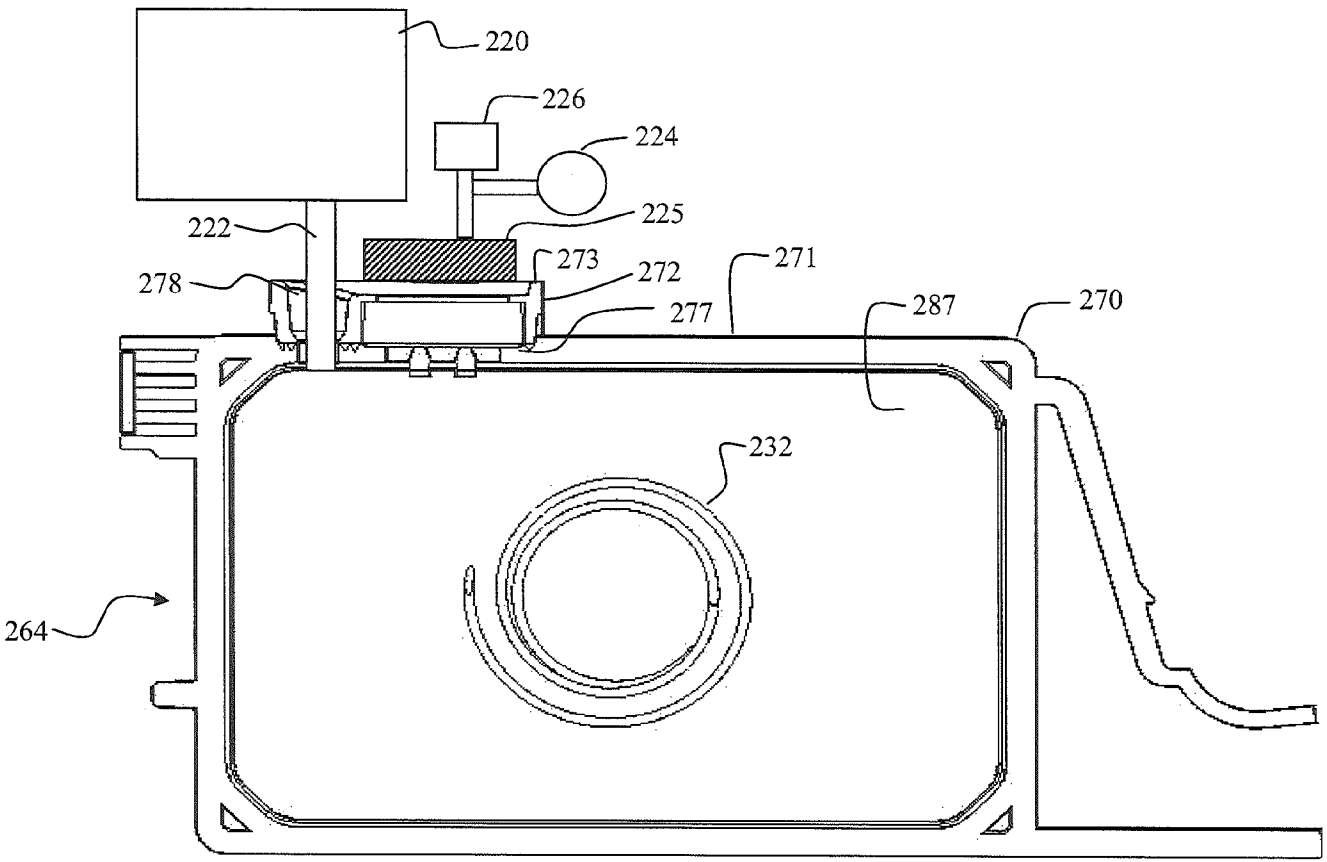
FIG. 14 is a schematic view of an ink filling process for an ink tank according to an embodiment of the invention.

In such embodiments where a wetted screen 277 prevents passage of air through the ink supply port 275, it can be advantageous to fill the ink tank 264 with the port member 272 facing upward, as shown in the cross sectional view of FIG. 14. Ink fill port 278 is configured to receive an ink fill tube 222 that is connected to ink source 220. At the beginning of ink fill, plate 234, spring 232 and flexible wall 230 (see FIG. 13) are substantially compressed against rigid wall 287 (see FIG. 12) so that there is little air in reservoir 265. Alternatively, at the beginning of ink fill air can be allowed into reservoir 265 through ink supply port 275 and the expansion of flexible wall 230 can be limited by finger 231 (see FIG. 13) that pushes on the flexible wall 230 in a direction tending to compress spring 232 in order to adjust an upper limit ink fill level of reservoir 265. As ink flows into reservoir 265 from ink source 220 through ink fill tube 222, flexible wall 230 tends to expand outwardly from rigid wall 287. In some embodiments, a coupling connection 225 is fitted over ink supply port 275 and a vacuum source 226 pulls air out of reservoir 265 through ink supply port 275 during ink fill. The volume of reservoir 265 is typically set a bit larger than the desired volume in order to avoid splash back during filling. When the desired amount of ink has been filled into reservoir 265, the flow of ink is stopped and vacuum source 226 is used to pull out excess air. Optionally a pressure gauge 224 is used to monitor pressure while vacuum source 226 pulls out the air at this step. When enough air is drawn out so that ink contacts screen 277, the pressure level changes and a signal can be sent to cease applying vacuum from vacuum source 226, for example by closing a valve (not shown). Reservoir 265 typically has a holding capacity of 50 mL or less, but can be filled to lower fill volumes as well.

For such embodiments where the ink filling process should be done with the port member 272 facing upward, it can be appreciated that ink fill port 278 should be located on the same wall 271 of housing 270 that port member 272 is located on. If ink fill port 278 extended outward from wall 271 in any other position except within rim 273, it would interfere with installing single chamber ink tank 264 into printhead 250 (see FIG. 5). On the other hand, if ink fill port 278 extended inwardly into housing 270, it could interfere with expansion of flexible wall 230, and could inhibit filling above the lowest interior portion of ink fill port 278. Therefore for holding a given amount of ink in an ink tank, having the ink fill port 278 within rim 273 and extending outward results in a more compact design. Thus the advantage of locating ink fill port 278 within rim 273 of port member 272 (which also encloses ink supply port 275) is demonstrated.

Figure 15:
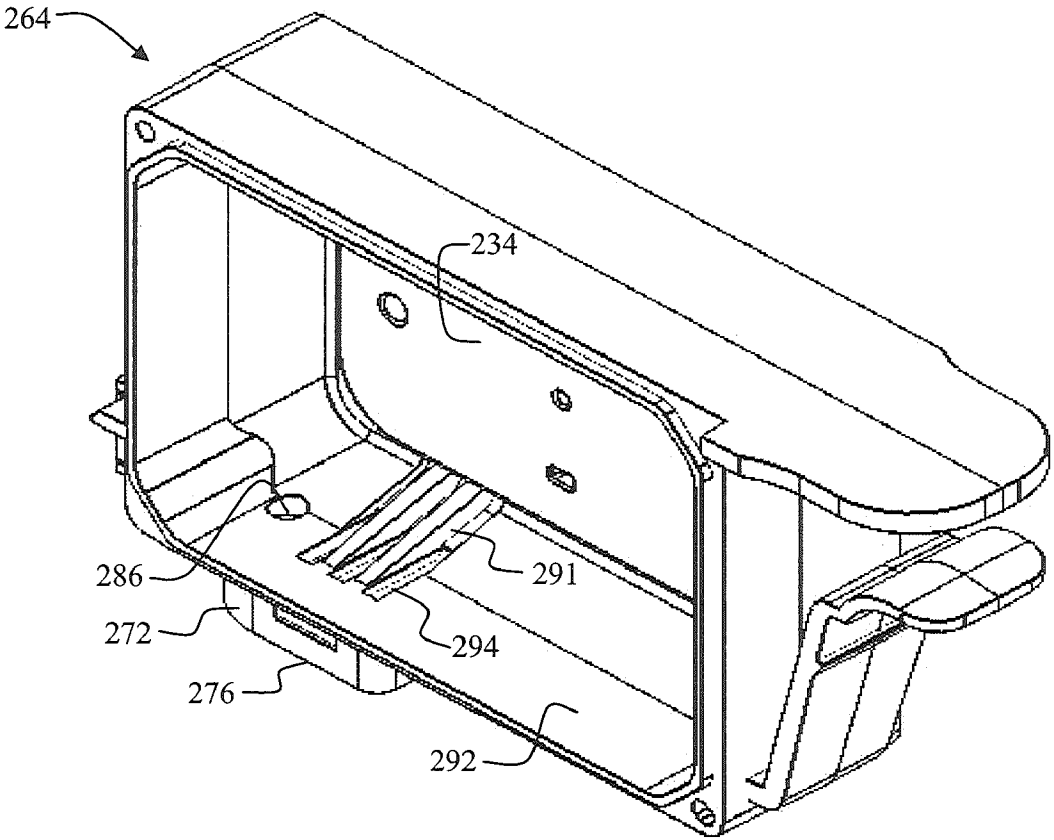
FIG. 15 is an interior view of an ink tank according to an embodiment of the invention.

FIG. 15 shows an interior view of single chamber ink tank 264 with flexible wall 230 compressed behind plate 234 and hidden so that other details can be seen. Hole 286 is connected to ink fill port 278 and ends flush with interior surface 292 so that reservoir 265 can be filled all the way full with ink. Ribs 291 hold flexible wall 230 away from interior surface 292 as it fills with ink. When the ink tank 264 is oriented as in FIG. 15, ink can pass through ink slots 294 into wick 276 (see FIG. 16).

Figure 16:
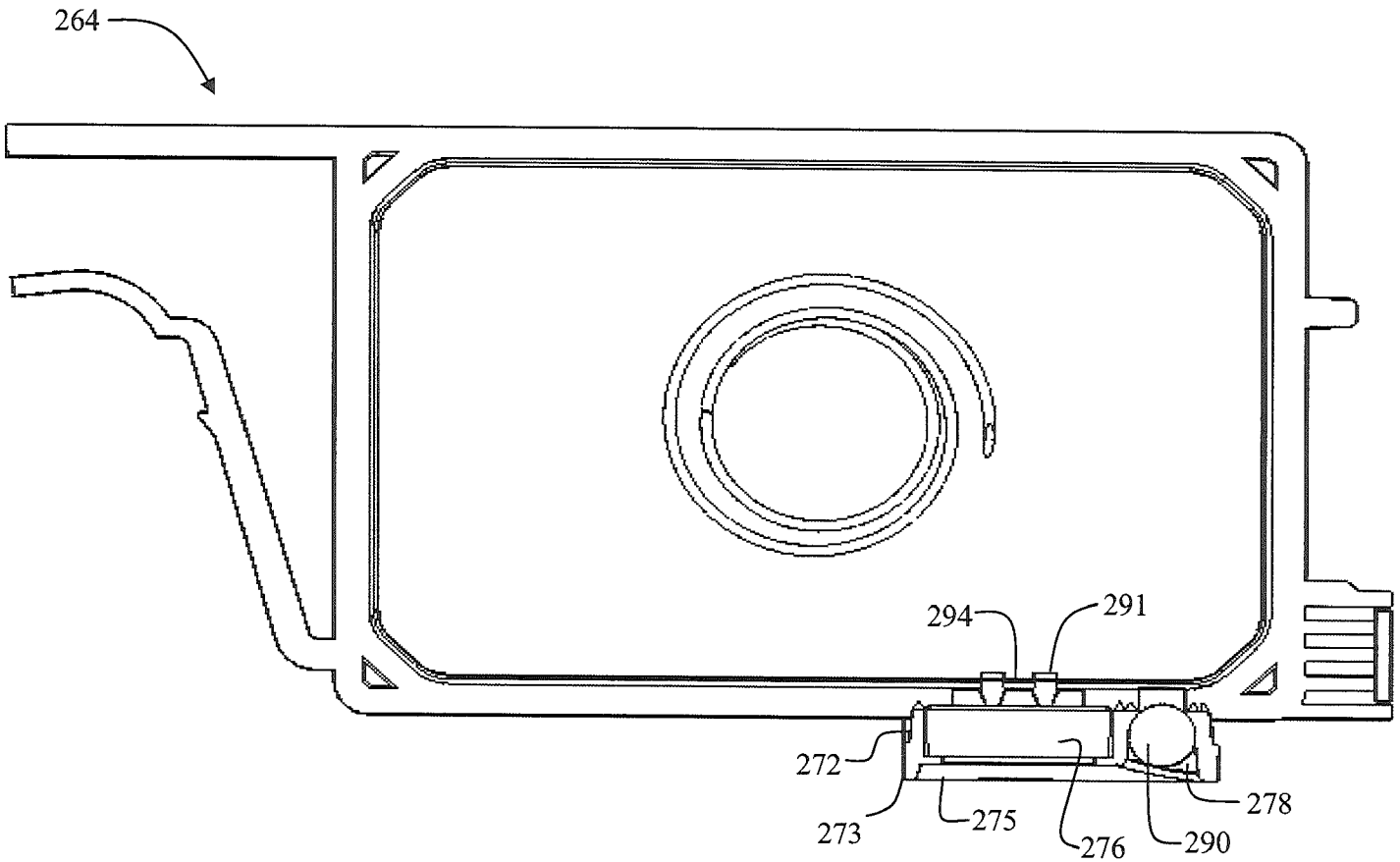
FIG. 16 is a cross sectional view of an ink tank according to an embodiment of the invention.

When the ink fill process is completed and liquid ink has been provided to the reservoir, a plug 290, configured to seal ink fill port 278, is inserted into ink fill port 278, as shown in FIG. 16. Plug 290 can be a compliant ball, for example, and can be press fitted into ink fill port 278. It can be difficult to remove a plug in order to refill the ink tank, though it can be done in some instances.

Figure 17:
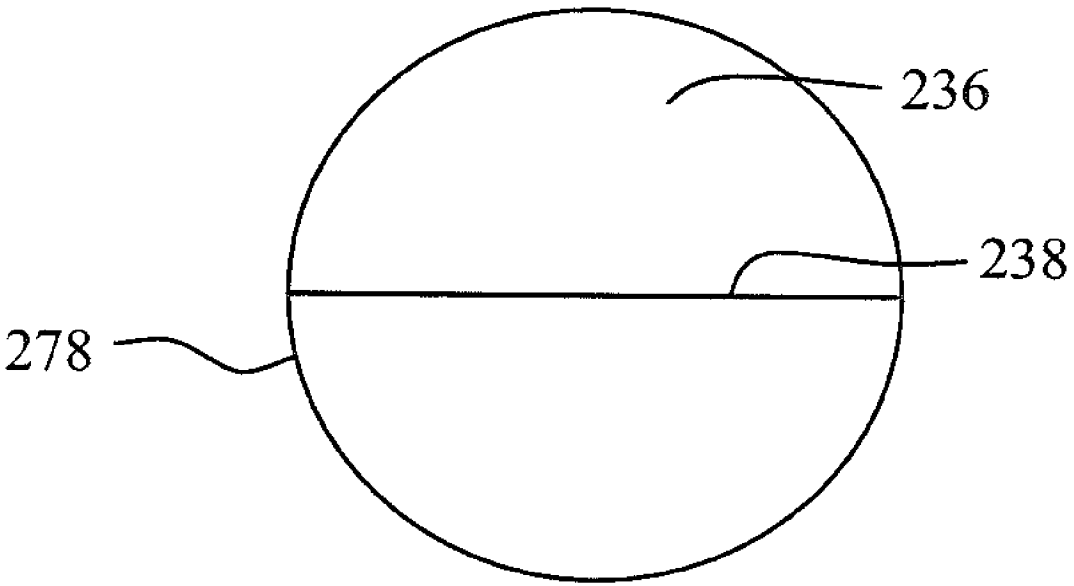
FIG. 17 is a schematic view of a septum seal.

FIG. 17 shows a bottom view of an embodiment where the ink fill port 278 includes a septum 236 with a slit 238. In such an embodiment, the ink fill tube (see FIG. 14) is inserted through the slit 238 in septum 236. After filling, the ink fill tube 222 is withdrawn and the slit 238 closes back up to seal septum 236. Such an embodiment is more conducive to refilling of an ink tank.

Because the manufacturer has designed or provided the ink specifically to be compatible with the printhead, with excellent image quality, and with long-lasting prints, refilling a depleted ink tank is not generally recommended other than by the manufacturer or its authorized provider, but in some instances it can be done. It must be done carefully in order not to introduce dirt into the reservoir and also not damage internal features such as the flexible wall 230. After obtaining an ink tank, a passageway in ink fill port 278 enclosed within rim 273 of port member 272 is opened (either by removing a plug 290 or opening a septum 236), an ink fill tube 222 is inserted in ink fill port 278, and the steps described above for original filling are carried out. In this instance, cover plate 285 can set the fill volume of reservoir 265 rather than finger 231.

In summary, the invention resides in a detachably mountable ink tank for an inkjet printhead, the ink tank includes a housing for enclosing a reservoir for liquid ink; a rim extending outwardly from the housing; an ink supply port enclosed within the rim; and an ink fill port enclosed within the rim, wherein the ink fill port is configured to receive an ink fill tube to provide liquid ink to the reservoir.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
220 Ink source
222 Ink fill tube
224 Pressure gauge
225 Coupling connection
226 Vacuum source
230 Flexible wall
231 Finger
232 Spring
234 Plate
236 Septum
238 Slit
240 Standpipe
241 Region (for mounting multi-chamber ink tank)
242 Inlet port
243 Hole
244 Hole
245 End
246 Region (for mounting single chamber ink tank)
247 Gasket
249 Wall
250 Printhead
251 Printhead die
253 Nozzle array
254 Nozzle array direction
256 Encapsulant
257 Flex circuit
258 Connector board
262 Multi-chamber ink tank
264 Single-chamber ink tank
265 Reservoir
270 Housing
271 Wall
272 Port member
273 Rim
274 Face
275 Ink supply port
276 Wick
277 Screen
278 Ink fill port
279 Wall
280 Pedestal
281 Electrical device
282 Electrical contacts
284 Latching lever
285 Cover plate
286 Hole
287 Rigid wall
288 Protrusion
290 Plug
291 Ribs
292 Interior surface
294 Ink slots
295 Compartment
296 Compartment
297 Wall
298 Attachment surface
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media

371 Top piece of medium
380 Carriage motor
382 Carriage guide rail
383 Encoder fence
384 Belt
390 Printer electronics board
392 Cable connectors

The invention claimed is:

1. A detachably mountable ink tank for an inkjet printhead, the ink tank comprising:
(a) a housing enclosing a reservoir for liquid ink;
(b) a rim extending outwardly from the housing;
(c) an ink supply port enclosed within the rim; and
(d) an ink fill port enclosed within the rim, wherein the ink fill port is configured to receive an ink fill tube to provide liquid ink to the reservoir; wherein the rim includes a face that sealingly fits against a gasket surrounding an inlet port of the printhead when the ink tank is installed in the printhead.

2. The detachably mountable ink tank of claim 1 further comprising a plug that is configured to seal the ink fill port after the liquid ink is provided to the reservoir.

3. The detachably mountable ink tank of claim 2, wherein the plug is a ball.

4. The detachably mountable ink tank of claim 3, wherein the ball is formed of a compliant material.

5. The detachably mountable ink tank of claim 3, wherein the ball is press fitted into the ink fill port.

6. The detachably mountable ink tank of claim 1, wherein the ink fill port includes a septum.

7. The detachably mountable ink tank of claim 1, wherein the reservoir includes a flexible wall.

8. The detachably mountable ink tank of claim 7, wherein the reservoir further includes a substantially rigid wall that is opposite a portion of the flexible wall.

9. The detachably mountable ink tank of claim 8, wherein the reservoir contains ink between the flexible wall and the substantially rigid wall.

10. The detachably mountable ink tank of claim 7, wherein the reservoir contains a spring between the flexible wall and the substantially rigid wall.

11. The detachably mountable ink tank of claim 1, wherein the housing includes a first and second wall, wherein the rim extends outwardly from the first wall and a pedestal extends outwardly from the second wall and an electrical device is mounted on the pedestal.

12. The detachably mountable ink tank of claim 1, wherein the rim is oblong-shaped.

13. The detachably mountable ink tank of claim 1, wherein the reservoir includes a holding capacity of 50 mL or less.

14. The detachably mountable ink tank of claim 1, wherein rim extends outwardly from the housing by 1 cm or less.

15. The detachably mountable ink tank of claim 1, wherein the rim, the ink supply port, and the ink fill port are provided by a molded component that is fixedly attached to the housing.

16. The detachably mountable ink tank of claim 15, wherein the molded component includes:
(a) a first compartment including the ink supply port;
(b) a second compartment including the ink fill port; and
(c) a wall separating the first compartment from the second compartment.

17. The detachably mountable ink tank of claim 16 further comprising an air tight seal between the first compartment and the second compartment of the fixedly attached molded component.

18. An inkjet printhead assembly comprising:
a) one or more detachably mountable ink tanks, the ink tank comprising
i) a housing for enclosing a reservoir for liquid ink;
ii) a rim extending outwardly from the housing;
iii) an ink supply port enclosed within the rim; and
iv) an ink fill port enclosed within the rim, wherein the ink fill port is configured to receive an ink fill tube to provide liquid ink to the reservoir; and
b) an inkjet printhead comprising:
i) an ink tank holding receptacle that receives one or more detachably mountable ink tanks;
ii) one or more ink inlet ports configured to contact the ink supply port within the rim of the ink tank; and
iii) a compliant gasket disposed around the one or more ink inlet ports, wherein the compliant gasket seals against a face of the rim of the ink tank when the ink tank is installed in the ink tank holding receptacle of the inkjet printhead.

19. The inkjet printhead assembly of claim 18, the ink tank further comprising a pedestal and an electrical device mounted on the pedestal, wherein the ink tank holding tank receptacle of the inkjet printhead further includes a hole into which the pedestal extends when the ink tank is installed in the ink tank holding receptacle of the inkjet printhead.

* * * * *